US009249987B2

(12) United States Patent
Foster et al.

(10) Patent No.: US 9,249,987 B2
(45) Date of Patent: Feb. 2, 2016

(54) MOUNTING BRACKET FOR USE WITH A WATER HEATER

(71) Applicant: Honeywell International Inc., Morristown, NJ (US)

(72) Inventors: Regan Foster, Morristown, NJ (US); Thomas M. Johnson, Minneapolis, MN (US); Don C. Kennedy, Brooklyn Park, MN (US); Lynn Fliger, Brooklyn Park, MN (US); Bruce L. Hill, Roseville, MN (US)

(73) Assignee: Honeywell International Inc., Morristown, NJ (US)

( * ) Notice: Subject to any disclaimer, the term of this patent is extended or adjusted under 35 U.S.C. 154(b) by 399 days.

(21) Appl. No.: 13/754,569

(22) Filed: Jan. 30, 2013

(65) Prior Publication Data

US 2014/0209767 A1 Jul. 31, 2014

(51) Int. Cl.
*F24H 9/20* (2006.01)

(52) U.S. Cl.
CPC ..... *F24H 9/2007* (2013.01); *F24D 2220/04* (2013.01)

(58) Field of Classification Search
CPC ..... F24H 9/2007; F24D 2220/04
USPC ..... 248/220.21; 374/208
See application file for complete search history.

(56) References Cited

U.S. PATENT DOCUMENTS

| | | | |
|---|---|---|---|
| 2,107,468 | A | 2/1938 | Canuteson |
| 3,847,350 | A | 11/1974 | Thompson |
| 3,849,350 | A | 11/1974 | Matsko |
| 4,324,944 | A | 4/1982 | Weihrich et al. |
| RE30,936 | E | 5/1982 | Kmetz et al. |
| 4,333,002 | A | 6/1982 | Kozak |
| 4,467,178 | A | 8/1984 | Swindle |
| 4,508,261 | A | 4/1985 | Blank |
| 4,511,790 | A | 4/1985 | Kozak |
| 4,568,821 | A | 2/1986 | Boe |
| 4,588,875 | A | 5/1986 | Kozak et al. |
| 4,692,598 | A | 9/1987 | Yoshida et al. |

(Continued)

FOREIGN PATENT DOCUMENTS

| | | |
|---|---|---|
| EP | 0356609 | 3/1990 |
| EP | 0699316 | 7/1999 |

(Continued)

OTHER PUBLICATIONS

Lennox, "Network Control Panel, User's Manual," 18 pages, Nov. 1999.

(Continued)

*Primary Examiner* — Lisa Caputo
*Assistant Examiner* — Philip Cotey
(74) *Attorney, Agent, or Firm* — Seager, Tufte & Wickhem LLP

(57) ABSTRACT

A mounting bracket for mounting a temperature sensor, a gas valve, a power delivery unit, a controller and/or any other suitable object or device to a water heater tank. An illustrative but non-limiting example may be found in a mounting bracket that includes a polymeric body that has a sensor portion configured to receive a temperature sensor. The sensor portion may have a distal end that extends into and supports the temperature sensor within the water heater tank, and may include a shell disposed over at least a portion of the sensor portion.

20 Claims, 9 Drawing Sheets

(56) References Cited

U.S. PATENT DOCUMENTS

| | | | | |
|---|---|---|---|---|
| 4,696,639 | A | 9/1987 | Bohan, Jr. | |
| 4,734,658 | A | 3/1988 | Bohan, Jr. | |
| 4,742,210 | A | 5/1988 | Tsuchiyama et al. | |
| 4,770,629 | A | 9/1988 | Bohan, Jr. | |
| 4,834,284 | A | 5/1989 | Vandermeyden | |
| 4,944,454 | A | 7/1990 | Widemann et al. | |
| 4,984,981 | A | 1/1991 | Pottebaum | |
| 4,986,468 | A | 1/1991 | Deisinger | |
| 5,007,156 | A | 4/1991 | Hurtgen | |
| 5,103,078 | A | 4/1992 | Boykin et al. | |
| 5,442,157 | A | 8/1995 | Jackson | |
| 5,448,038 | A | 9/1995 | Kim | |
| 5,622,200 | A | 4/1997 | Schulze | |
| 5,660,328 | A | 8/1997 | Momber | |
| 5,779,143 | A | 7/1998 | Michaud et al. | |
| 5,797,358 | A | 8/1998 | Brandt et al. | |
| 5,896,089 | A | 4/1999 | Bowles | |
| 5,968,393 | A | 10/1999 | Demaline | |
| 5,975,884 | A | 11/1999 | Dugger | |
| 6,053,130 | A | 4/2000 | Shellenberger | |
| 6,059,195 | A | 5/2000 | Adams et al. | |
| 6,069,998 | A | 5/2000 | Barnes et al. | |
| 6,075,923 | A | 6/2000 | Wu | |
| 6,208,806 | B1 | 3/2001 | Langford | |
| 6,212,894 | B1 | 4/2001 | Brown et al. | |
| 6,261,087 | B1 | 7/2001 | Bird et al. | |
| 6,271,505 | B1 | 8/2001 | Henderson | |
| 6,293,471 | B1 | 9/2001 | Stettin et al. | |
| 6,350,967 | B1 | 2/2002 | Scott | |
| 6,363,218 | B1 | 3/2002 | Lowenstein et al. | |
| 6,371,057 | B1 | 4/2002 | Henderson | |
| 6,375,087 | B1 | 4/2002 | Day et al. | |
| RE37,745 | E | 6/2002 | Brandt et al. | |
| 6,553,946 | B1 | 4/2003 | Abraham et al. | |
| 6,560,409 | B2 | 5/2003 | Troost, IV | |
| 6,633,726 | B2 | 10/2003 | Bradenbaugh | |
| 6,701,874 | B1 | 3/2004 | Schultz et al. | |
| 6,732,677 | B2 | 5/2004 | Donnelly et al. | |
| 6,795,644 | B2 | 9/2004 | Bradenbaugh | |
| 6,861,221 | B2 | 3/2005 | Ghent | |
| 6,861,621 | B2 | 3/2005 | Ghent | |
| 6,880,493 | B2 | 4/2005 | Clifford | |
| 6,934,862 | B2 | 8/2005 | Sharood et al. | |
| 6,936,798 | B2 | 8/2005 | Moreno | |
| 6,955,301 | B2 | 10/2005 | Munsterhuis et al. | |
| 6,959,876 | B2 | 11/2005 | Chian et al. | |
| 6,973,819 | B2 | 12/2005 | Ruhland et al. | |
| 7,088,238 | B2 | 8/2006 | Karaoguz et al. | |
| 7,117,825 | B2 | 10/2006 | Phillips | |
| 7,137,373 | B2 | 11/2006 | Seymour, II et al. | |
| 7,162,150 | B1 | 1/2007 | Welch et al. | |
| 7,221,862 | B1 | 5/2007 | Miller et al. | |
| 7,252,502 | B2 | 8/2007 | Munsterhuis | |
| 7,317,265 | B2 | 1/2008 | Chian et al. | |
| 7,478,560 | B2 | 1/2009 | Kuznia et al. | |
| 7,712,677 | B1 | 5/2010 | Munsterhuis et al. | |
| 7,970,494 | B2 | 6/2011 | Fima | |
| 8,226,293 | B2 | 7/2012 | Faries, Jr. et al. | |
| 8,245,987 | B2 | 8/2012 | Hazzard et al. | |
| 8,273,221 | B2 | 9/2012 | Schneider et al. | |
| 8,337,081 | B1 | 12/2012 | Holmberg et al. | |
| 8,523,432 | B2 * | 9/2013 | Mujumdar et al. | 374/208 |
| 2004/0042772 | A1 | 3/2004 | Whitford et al. | |
| 2004/0267385 | A1 | 12/2004 | Lingemann | |
| 2005/0077368 | A1 | 4/2005 | Zak et al. | |
| 2005/0147401 | A1 | 7/2005 | Baxter | |
| 2005/0147402 | A1 | 7/2005 | Baxter | |
| 2005/0150967 | A1 | 7/2005 | Chapman, Jr. et al. | |
| 2005/0185696 | A1 * | 8/2005 | Nakabayashi | 374/145 |
| 2005/0265426 | A1 * | 12/2005 | Hanzawa et al. | 374/208 |
| 2006/0013282 | A1 * | 1/2006 | Hanzawa et al. | 374/163 |
| 2006/0243816 | A1 | 11/2006 | Teti | |
| 2007/0023333 | A1 | 2/2007 | Mouhebaty et al. | |
| 2007/0034169 | A1 | 2/2007 | Phillips | |
| 2007/0191994 | A1 | 8/2007 | Patterson et al. | |
| 2007/0246551 | A1 | 10/2007 | Phillips et al. | |
| 2007/0295823 | A1 | 12/2007 | Yamada et al. | |
| 2008/0023564 | A1 | 1/2008 | Hall | |
| 2008/0188995 | A1 | 8/2008 | Hotton et al. | |
| 2010/0095906 | A1 | 4/2010 | Leeland et al. | |
| 2010/0195698 | A1 * | 8/2010 | Hori | 374/148 |
| 2010/0254428 | A1 * | 10/2010 | Rose et al. | 374/183 |
| 2011/0122918 | A1 | 5/2011 | Murray | |
| 2011/0147549 | A1 | 6/2011 | Hazzard et al. | |
| 2011/0147552 | A1 | 6/2011 | Hazzard et al. | |
| 2012/0017708 | A1 | 1/2012 | Pohle et al. | |
| 2012/0201269 | A1 * | 8/2012 | Mujumdar et al. | 374/141 |
| 2013/0128925 | A1 * | 5/2013 | Hoenicka et al. | 374/208 |

FOREIGN PATENT DOCUMENTS

| | | |
|---|---|---|
| GB | 2211331 | 6/1999 |
| JP | 8264469 | 10/1996 |
| JP | 2008008548 | 1/2008 |

OTHER PUBLICATIONS

Moog, "M3000 Control System, RTEMP 8, Remote 8-Channel Temperature Controller with CanOpen Interface," 6 pages, Nov. 2004.

* cited by examiner

MOUNTING BRACKET FOR USE WITH A WATER HEATER

TECHNICAL FIELD

The disclosure relates generally to water heaters, and more particularly, to a mounting bracket for a water heater for mounting a temperature sensor, a gas valve, a power delivery unit, a controller and/or any other suitable object or device to the water heater.

BACKGROUND

Water heaters are used in homes, businesses and just about any establishment having the need for heated water. A conventional water heater typically has at least one heating element or "heater," such as a gas-fired burner and/or electric heating element. Each water heater also typically has at least one thermostat or controller for controlling the heater. The controller typically receives signals related to the temperature of the water within the water heater tank, often from a temperature sensor that is thermally engaged with the water in the water heater tank.

In some instances, a water heater may operate in accordance with a first temperature set point and a second temperature set point. The difference between the first and second temperature set point may be referred to as the temperature differential of the water heater. When temperature signals from the temperature sensor indicate that the water temperature is below the first set point, for example when the water temperature is below about 120° F., the controller may turn on the heater and the water within the water heater tank begins to heat. After some time, the water temperature within the water heater tank will increase to the second set point, which, for example may be about 140° F. At this point, the controller may cause the heater to reduce its heat output or, alternatively, causes the heater to turn off. This heat cycle begins again when the water temperature within the water heater tank cools down below the first set point, such as below about 120° F.

For a gas fired water heater, a temperature sensor, a gas valve and a controller are often mounted relative to the water heater tank. The controller typically receives a temperature signal from the temperature sensor. The temperature sensor often protrudes into and is thermally coupled to the water in the water heater tank. The controller typically is programmed to control the gas valve such that the temperature of the water in the water heater tank remains between the first and second temperature set points, as described above. For an electric water heater, a temperature sensor, a power delivery unit and a controller may be mounted to the water heater tank. In this case, the controller may control the power delivery unit such that the temperature of the water in the water heater tank is kept between the first and second temperature set points.

What would be desirable is an improved mounting bracket for mounting the temperature sensor, the gas valve, the power delivery unit, the controller and/or any other suitable object or device to the water heater.

SUMMARY

The present disclosure relates generally to an improved mounting bracket for mounting a temperature sensor, a gas valve, a power delivery unit, a controller and/or any other suitable object or device to a water heater. An illustrative but non-limiting example of the disclosure may be found in a mounting bracket that includes a polymeric body that has a sensor portion configured to receive a temperature sensor.

The sensor portion may have a distal end that extends into and supports the temperature sensor within the water tank. In some cases, the sensor portion may be an elongated stem that has an internal well for receiving the temperature sensor. The polymeric body may also include a first threaded portion that is configured to threadably engage a threaded spud of the water heater such that when the threaded portion threadably engages the threaded spud of the water heater, the sensor portion extends into the water tank of the water heater. In some embodiments, the mounting bracket may include a component retaining region. The component retaining region may be use to retain a gas valve, a power delivery unit, a controller and/or any other suitable object or device relative to the water heater.

A shell may be disposed over and surround at least a portion of the sensor portion. In some instances, the shell may be formed from a different material than the polymeric body. For example, in some embodiments, the polymeric body may include a nylon material while the shell may include a metal material such as stainless steel or brass. In some cases, the shell may be mechanically deformed (e.g. crimped) to engage a mating feature on the sensor portion to help secure the shell to the sensor portion. Alternatively, the shell may be attached to the sensor in other manners, such as, but not limited to, threadably engaging the sensor portion, through adhesives, shrink wrapping, etc. In some instances, a cavity may be formed between the shell and the sensor portion. In some cases, this cavity may be at least partially filled. For example, the cavity may be at least partially filled with a thermally conductive silicone gel, water from the water tank of the water heater, or any other suitable material.

BRIEF DESCRIPTION OF THE FIGURES

The following description should be read with reference to the drawings. The drawings, which are not necessarily to scale, depict selected embodiments and are not intended to limit the scope of the disclosure. The disclosure may be more completely understood in consideration of the following detailed description of various embodiments in connection with the accompanying drawings, in which.

Figure 1:
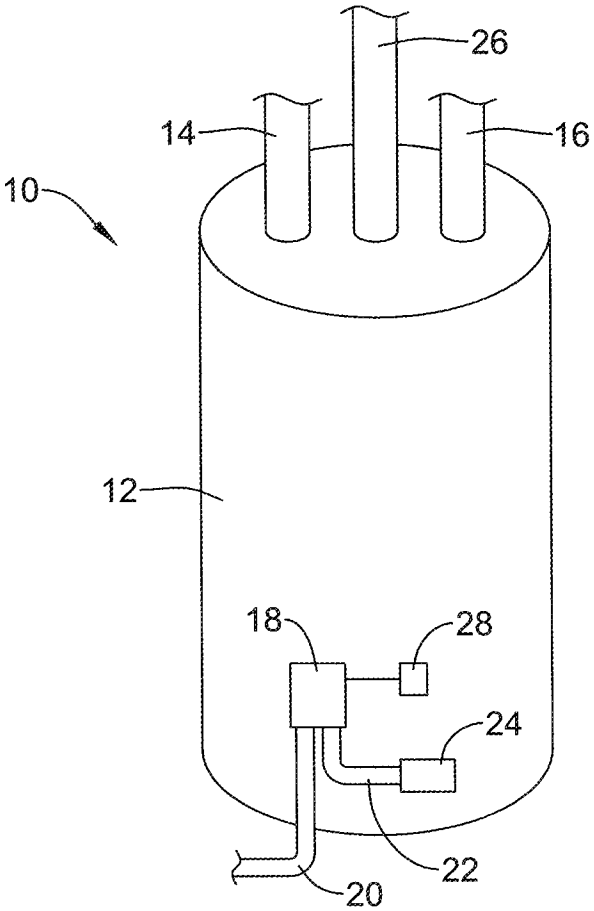
FIG. 1 is a schematic view of an illustrative but non-limiting water heater in accordance with the present disclosure.

While the disclosure is amenable to various modifications and alternative forms, specifics thereof have been shown by way of example in the drawings and will be described in detail. It should be understood, however, that the intention is not to limit the disclosure to the particular examples described. On the contrary, the intention is to cover all modifications, equivalents, and alternatives falling within the spirit and scope of the disclosure.

DESCRIPTION

The following description should be read with reference to the drawings, in which like elements in different drawings are numbered in like fashion. The drawings, which are not necessarily to scale, depict several examples that are not intended to limit the scope of the disclosure. Although examples of construction, dimensions, and materials are illustrated for the various elements, those skilled in the art will recognize that many of the examples provided have suitable alternatives that may be utilized.

FIG. 1 is a schematic view of an illustrative but non-limiting water heater 10. Illustrative water heater 10 includes a water tank 12. The water tank 12 may include an insulating layer (not explicitly shown) positioned about the water tank 12 to help reduce thermal losses from the water tank 12. In the example shown, cold water enters water tank 12 through a cold water line 14 and is heated by a gas burner 24. In some cases, the water heater 10 may include an electric heating element rather than a gas burner 24. A power delivery unit (not shown) may be used to selectively apply power (i.e. current) to the electric heating element. In either case, the resulting heated water exits through a hot water line 16. For gas-fired water heaters, a gas control unit 18 such as a gas valve regulates gas flow from a gas source 20 through a combustion gas line 22 and into gas burner 24. A flue 26 permits combustion byproducts to safely exit.

Figure 2:
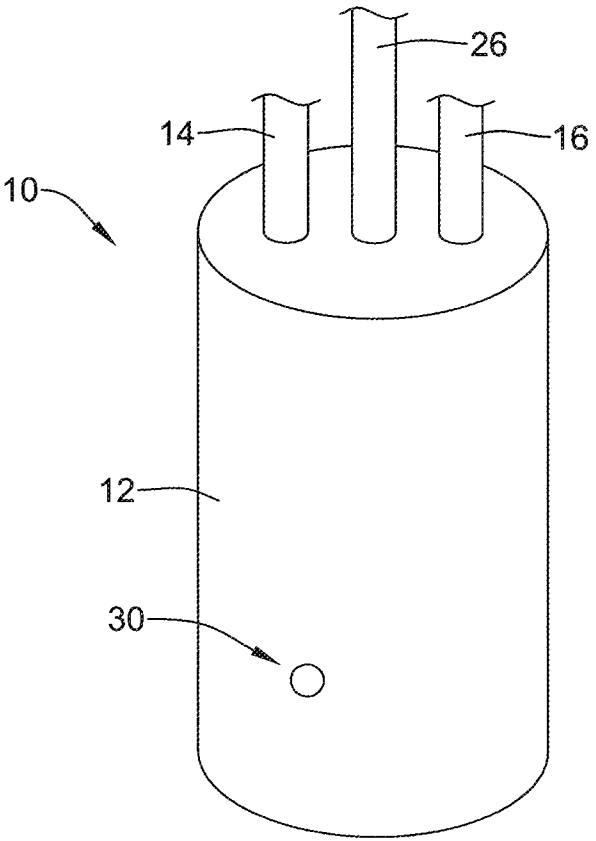
FIG. 2 is a schematic view of an illustrative but non-limiting water heater in accordance with the present disclosure.

As can be seen, water heater 10 includes a temperature sensor 28. In some cases, temperature sensor 28 may enter water tank 12 at a location laterally offset from gas control unit 18. In some instances, however, temperature sensor 28 may instead be located behind gas control unit 18, and in some cases, may be supported and retained by a common mounting bracket such as that described more fully below. In any event, water tank 12 may include an aperture 30 that is sized and configured to accept temperature sensor 28. This can be seen in FIG. 2, in which certain elements of FIG. 1 have been removed for clarity. In some cases, aperture 30 may include threads that are configured to accommodate corresponding matching threads on temperature sensor 28. In some cases, temperature sensor 28 has a compression or frictional fit within aperture 30. In some instances, water tank 12 may include a threaded spud (not explicitly shown) that is configured to receive temperature sensor 28.

Figure 3:
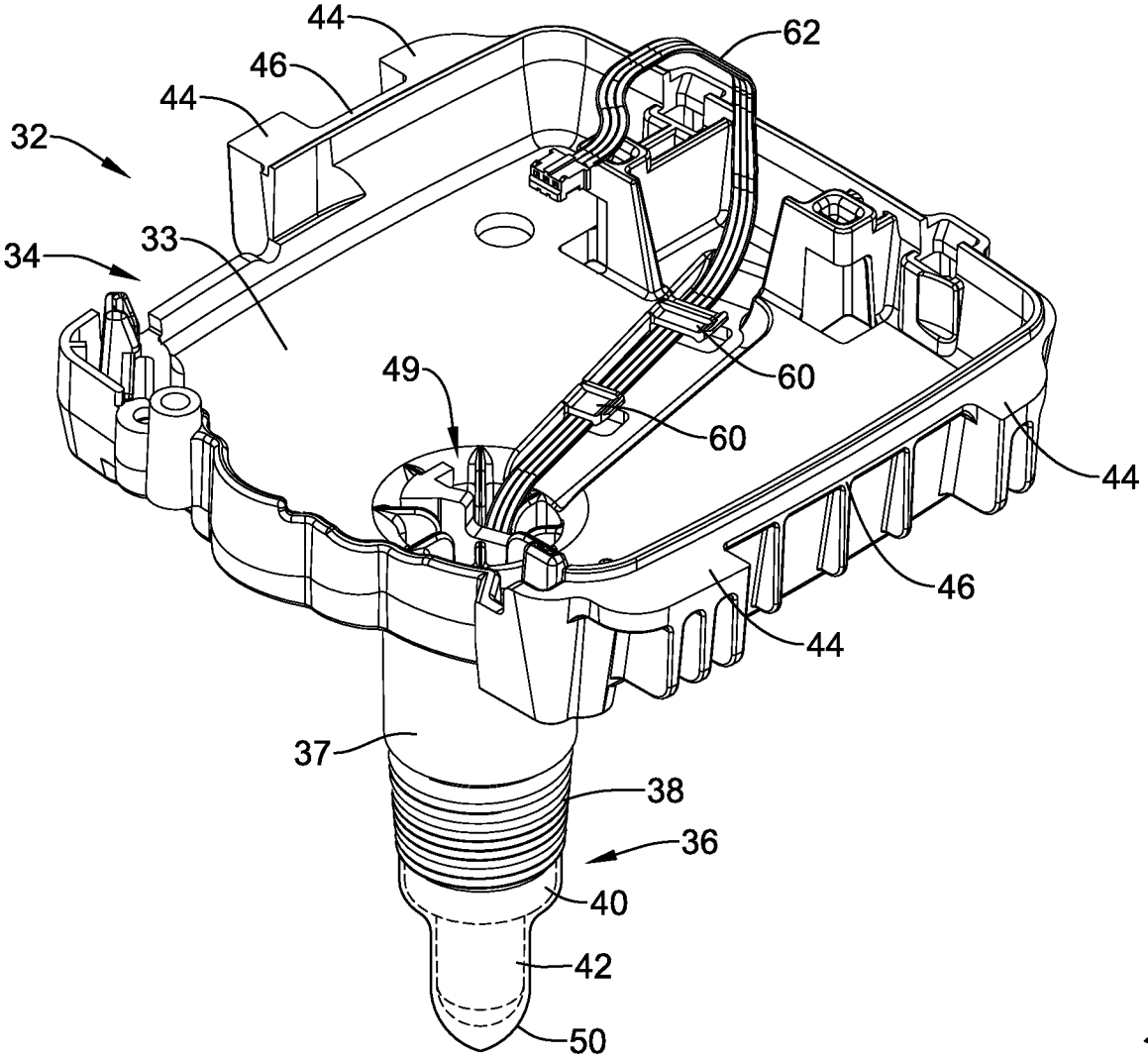
FIG. 3 is a perspective view of an illustrative but non-limiting mounting bracket that may be used in conjunction with the water heater of FIG. 1.

FIG. 3 is a perspective view of an illustrative but non-limiting mounting bracket 32 that may be used in conjunction with the water heater 10. In some instances, the mounting bracket 32 may include a component retaining region 33, and a sensor portion 36 forming an elongated stem. Bracket 32 may be configured to retain a gas valve module and/or a water heater controller module (not explicitly shown) within component retaining region 33, as well as a temperature sensor assembly 49 within elongated sensor portion 36. In the illustrative embodiment, bracket 32 includes a gas valve retaining portion 34 and a sensor portion 36. Gas valve retaining portion 34 may form at least a portion of a housing of a gas control unit, such as gas control unit 18 of FIG. 1, but this is not required. In some instances, as illustrated, elongated sensor portion 36 may include a threaded portion 38 that can be used to secure bracket 32 to or within aperture 30 (FIG. 2) of a water heater spud.

Wiring harness 62 may be configured to extend from temperature sensor assembly 49 and to a gas control unit, such as the gas control unit 18 illustrated in FIG. 1. Component retaining region 33 may include retaining elements 60 for retaining wiring harness 62. Retaining elements 60 may be molded in such a way as to allow the use of an optical sensor in production to ensure that the wiring harness 62 and/or sensor wires are properly installed. For example, bracket 32 may be molded such that an opening is present behind retaining elements 60. While not explicitly shown, component retaining region 33 may also include retaining elements for retaining a water heater controller module and/or gas valve module, if desired.

Bracket 32 may be formed of any suitable material. In some cases, bracket 32 may include non-metallic materials such as a polymeric material, glass, ceramic, plastic, and the like. In some cases, bracket 32 may be manufactured as a single piece by injection molding a nylon material such Hylon®, available from Entec Polymers in Manchester, Tenn. The thermal conductivity of such non-metallic materials may be less than those of metallic materials, and as a result, may partially thermally isolate the temperature sensor assembly 49 from the water in the water tank 12, but may be less expensive to produce than a metallic well. It is contemplated that in some cases, bracket 32 may not be formed entirely from the same material, or bracket 32 may not be formed as a single piece.

Sensor portion 36 of the bracket 32 may include an elongated stem extending from component retaining region 33. Sensor portion 36 may include an internal well 39 (shown in more detail in FIG. 5) for receiving the temperature sensor assembly 49. The elongated stem of sensor portion 36 may have several different regions or portions. For example, sensor portion 36 may include a first portion 37, a threaded region 38 extending around the exterior of the sensor portion 36, a thread lead-in region 40, and an enclosed distal end region 42. Threaded region 38 may be configured to threadably engage a threaded spud of the water tank 12. Thread lead-in region 40 may be disposed between the distal end region 42 and the threaded region, and may be configured to help guide the sensor portion 36 into the aperture 30 of the water tank 12 with proper alignment for the threaded region 38 to engage the threaded spud of the water tank 12. In some embodiments, the thread lead-in region 40 may have zero draft for maximum effectiveness, but this is not required. When threaded region 38 is engaged with the threaded water heater spud, distal end 42 of the sensor portion 36 may be disposed within water tank 12. Distal end 42 may house a temperature sensor such that when the bracket 32 is engaged with the water tank 12, the temperature sensor of the temperature sensor assembly 49 is in at least partial thermal communication with the water in the water tank 12.

In some instances, distal end region 42 may have a reduced cross-sectional area relative to remaining regions 37, 38 and 40 of sensor portion 36. However, it is contemplated that in some cases, the cross-sectional area of distal end 42 may be the same as, or substantially the same as the remaining regions 37, 38 and 40 of sensor portion 36. In some embodiments, distal end 42 may include a cutting element (not explicitly shown) disposed at or near the tip. In some instances, the cutting element may include a blade-like feature. The cutting element may be capable of puncturing and/or piercing a plastic sheet or barrier commonly wrapped around the water tank 12 of many water heaters during installation of the bracket 32. It is contemplated that in some cases, the cutting element may be omitted from the design.

Figure 4:
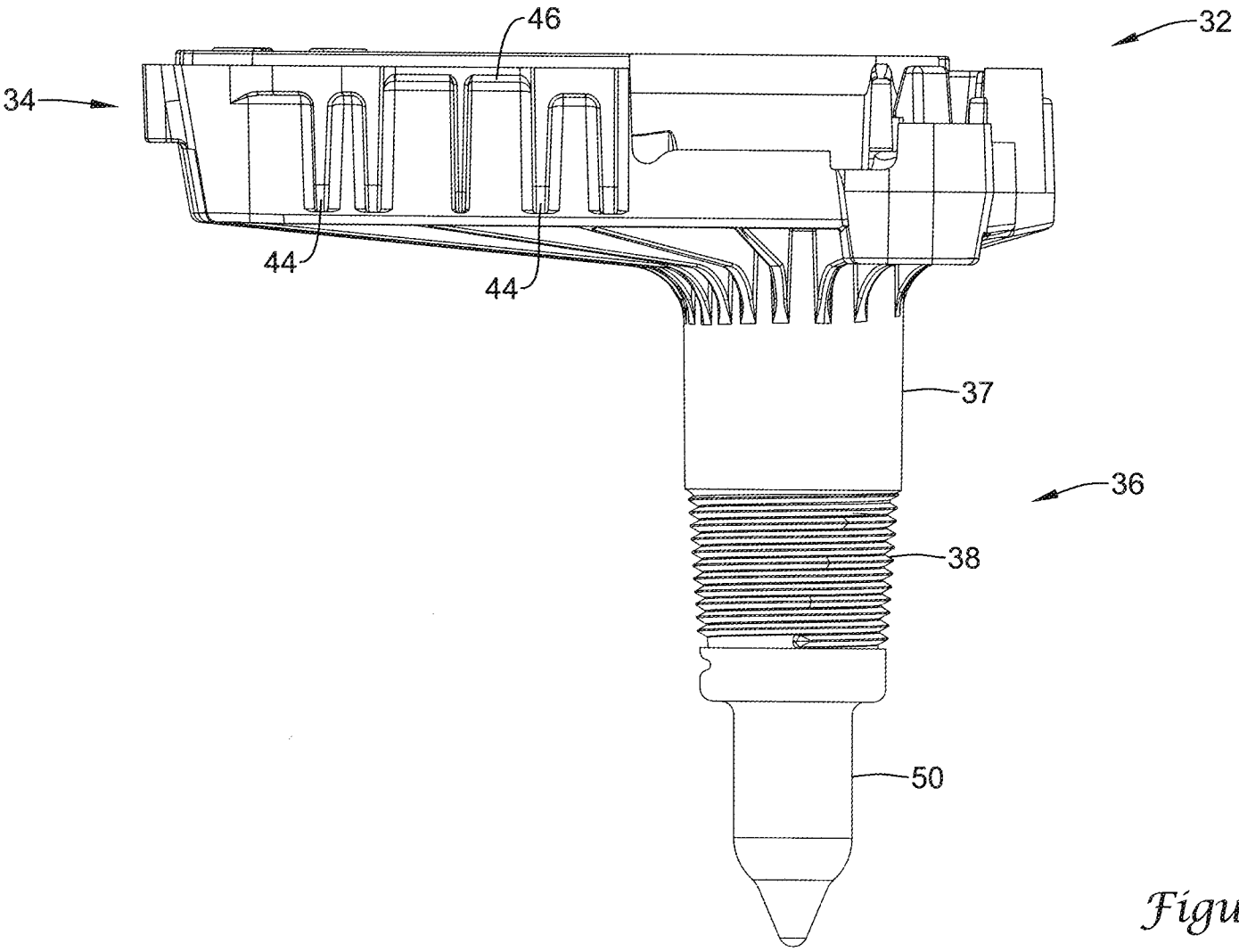
FIG. 4 is a side view of the illustrative but non-limiting mounting bracket of FIG. 3.

Referring to FIGS. 3 and 4, in some embodiments, distal end region 42 and thread lead-in region 40 may include a shell or cap 50 configured to protect distal end region 42 and/or thread lead-in region 40 from water related degradation. Shell 50 may be disposed over distal end region 42 and thread lead-in region 40 as shown, and may be secured to sensor portion 36 such that shell 50 surrounds the distal end region 42. In some instances, shell 50 may be secured such that a layer of water may be disposed between shell 50 and the sensor portion 36 of bracket 32, but this is not required. This may reduce the volumetric flow rate of water over the surface of sensor portion 36 while still allowing water to contact elongated sensor portion 36. A reduced volumetric flow rate (compared to a sensor portion 36 with no shell) may reduce water related degradation of the sensor portion material while still maintaining low cost and good controller functionality. In some cases, one or more holes may be added to the shell 50 to allow water to flow through the shell 50, but at a reduced the volumetric flow rate relative to when no shell 50 is provided. In some cases, at least part of the shell 50 may be made from a screen or grate that allows water to flow through but at a reduced volumetric flow rate.

It is further contemplated that shell 50 may allow for near-zero change in the thermal time constant of sensor portion 36 and/or the temperature sensor relative to a bracket with no shell 50. In some instances, shell 50 may have a shape similar to the profile of thread lead-in portion 40 and distal end region 42 of the sensor portion 36. However, this is not required. The distance between sensor portion 36 and shell 50 may be exaggerated in the Figures to better illustrate the different components. It is contemplated that shell 50 may be sized and shaped as desired to achieve the desired spacing between sensor portion 36 and shell 50. In some instances, shell 50 may be formed of stainless steel. However, it is contemplated that shell 50 may be formed of any suitable material, such as, but not limited to, brass, other metals or metal alloys, ceramics, polymers, or polymer blends.

In some embodiments, bracket 32 may also include two (or more) bosses 44 on a first lateral side, and two (or more) bosses 44 on a second opposing lateral side. While bracket 32 is shown having four bosses 44, it is contemplated that bracket 32 may have any number of bosses 44 as desired, for example, but not limited to, one, two, three, or more. Additionally, it is contemplated that bosses 44 may be disposed on fewer, or more, than two lateral sides of the bracket. Bosses 44 may provide, among other things, an area for torque to be applied directly to the bracket 32 during installation. For example, an installation tool may grip and apply torque to bosses 44 to threadably engage threaded region 38 of sensor portion 36 with the threaded water heater spud on a water tank 12. In some instances, bosses 44 may further include a rib 46 disposed between adjacent bosses 44. Rib(s) 46 may provide additional support to the bracket 32, and may also help prevent an installation tool from contacting the component retaining region 33 of bracket 32 during installation.

Figure 5:
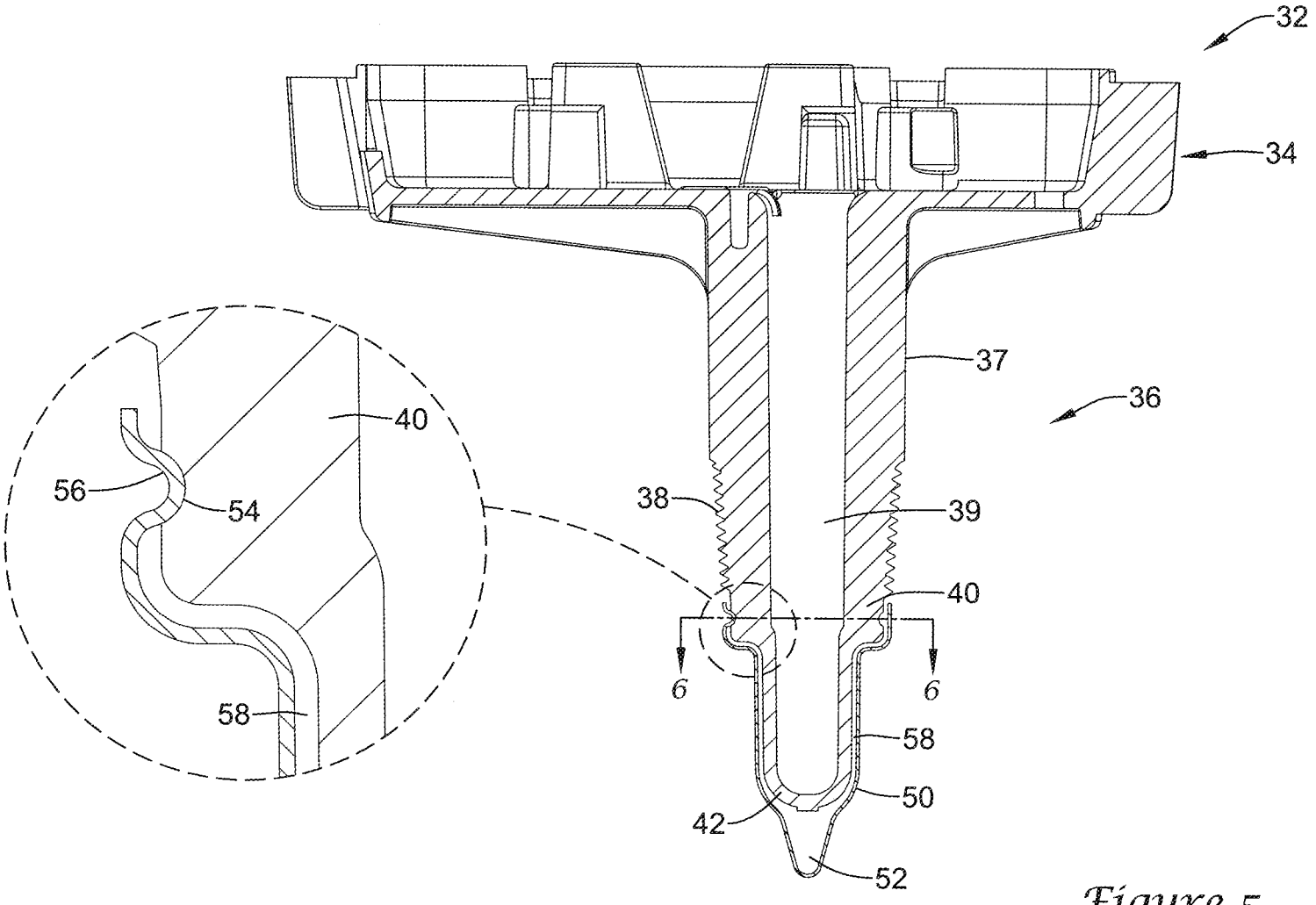
FIG. 5 is a cross-sectional side view of the illustrative but non-limiting mounting bracket of FIG. 3.
Figure 6:
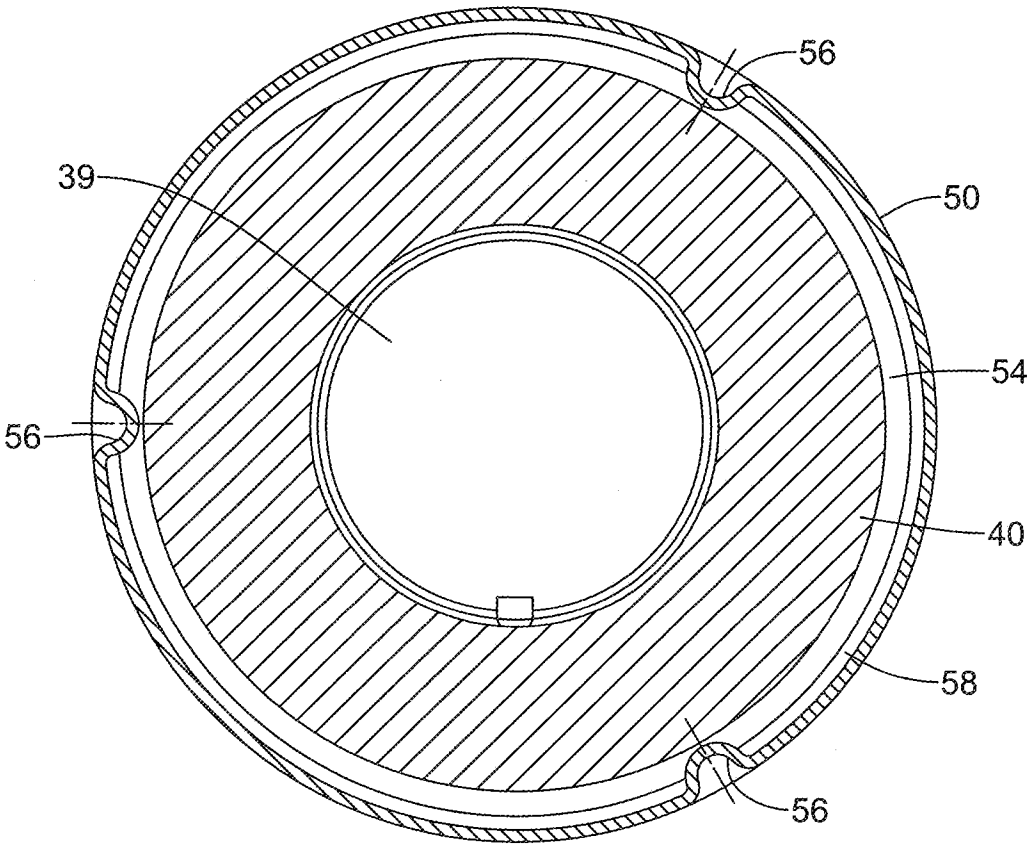
FIG. 6 is a cross-sectional view of the illustrative but non-limiting bracket of FIG. 5 taken along line 6-6.

Referring now to FIG. 5, in some instances, shell 50 may be secured to sensor portion 36 by mechanically deforming the shell 50, such as by crimping. In one example, shell 50 may be compressed or mechanically deformed into an opening or groove 54 formed in the thread lead-in portion 40 to create a crimp 56 that secures the shell 50 to the sensor portion 36. In some embodiments, crimps 56 may be created at discrete intervals about the circumference of shell 50, or may extend around the perimeter of the shell. In one example, three crimps 56 may be created and spaced approximately 120° from one another. FIG. 6 is a cross-section of sensor portion 36 taken at line 6-6 of FIG. 5. As can be seen, shell 50 includes three (3) crimps 56 at three locations equally spaced about the circumference of the shell 50. Any number of crimps may be used to secure shell 50 to sensor portion 36, such as, but not limited to: one, two, three, four, or more. In some instances, the crimp 56 may extend around the entire circumference of shell 50. It is further contemplated that the shell 50 may be crimped at any longitudinal location as desired. For example, while FIG. 5 illustrates the crimp 56 spaced distally from the proximal end of the shell 50, in some instances the proximal end itself may be crimped or folded inward and over a structure on the sensor portion 36 to secure the shell 50, if desired. It is contemplated that shell 50 may be secured to sensor portion 36 in any suitable manner. For example, in some instances, shell 50 may be configured to threadably engage sensor portion 36. In other instances, shell 50 may be secured to sensor portion 36 using an adhesive or other suitable bonding agent. It is further contemplated that shell 50 may be shrink wrapped over sensor portion 36 or formed as a unitary structure with sensor portion 36. In some instances, distal end region 42 of the sensor portion 36 itself may be formed of a different material that is more resistant to water degradation than the remaining portions of bracket 32.

In some instances, there may be a gap 58 between the shell 50 and the sensor portion 36 such that a layer of water (or other fluid) may be disposed between the shell 50 and the sensor portion 36 of bracket 32. This may reduce the volumetric flow rate of water over the surface of sensor portion 36 while still allowing water to contact and thermally engage sensor portion 36. A reduced volumetric flow rate (compared to a sensor portion 36 with no shell 50) may reduce water related degradation of the sensor portion while still maintaining low cost and good controller functionality. In some cases, one or more holes may be added to the shell 50 to allow water to flow through the shell 50, but at a reduced the volumetric flow rate relative to when no shell 50 is provided. In some cases, at least part of the shell 50 may be made from a screen or grate that allows water to flow through but at a reduced volumetric flow rate.

It is further contemplated that shell 50 may allow for near-zero change in the thermal time constant of sensor portion 36 and/or the temperature sensor relative to a bracket with no shell 50. It is contemplated that the size and shape of shell 50 may be adjusted to regulate the size of gap 58 and thus the amount of water allowed between shell 50 and sensor portion 36 when bracket 32 is engaged with a water tank. It is further contemplated that the number of crimps 56 and/or size of the crimps 56 may be adjusted to help control the amount of water flow between shell 50 and sensor portion 36 when bracket 32 is engaged with a water tank. In some embodiments, shell 50 may extend distally beyond the distal end of distal end region 42, although this is not required. This may create a cavity 52 at the distal end of shell 50. In some instances, such a cavity 52 may be filled with a thermally conductive silicone gel (not explicitly shown) to facilitate heat transfer from the shell 50 to the distal end region 42 of the sensor portion 36, which is where the temperature sensor of the temperature sensor assembly 49 may be located. In some instances, other thermally conductive materials may be disposed within cavity 52, when cavity 52 is provided. It is contemplated that in some embodiments, a thermally conductive adhesive may be disposed within cavity 52 to help secure shell 50 to sensor portion 36.

Figure 7:
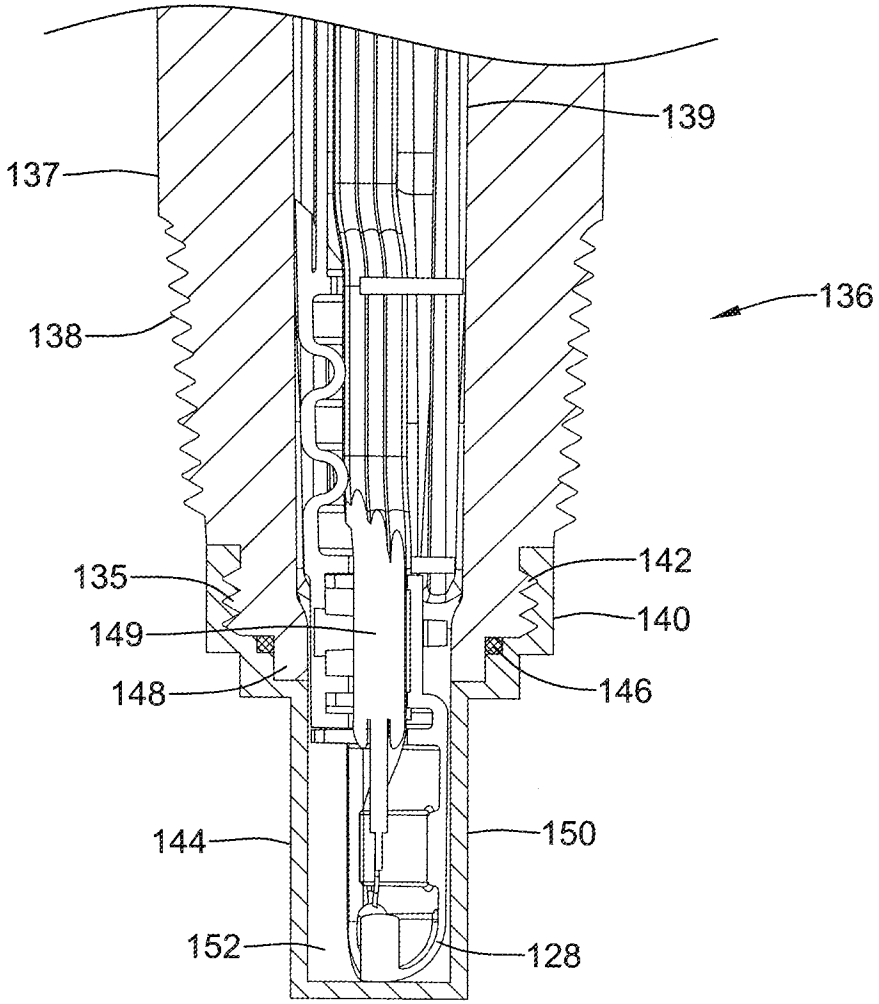
FIG. 7 is a cross-sectional side view of an end portion of another illustrative but non-limiting mounting bracket.

FIG. 7 illustrates another illustrative sensor portion 136 having a shell 150 that may be used in conjunction with a mounting bracket similar to bracket 32 discussed above. While not explicitly shown, it is contemplated that sensor portion 136 may extend from a gas valve retaining portion, having similar form and function to retaining portion 34 discussed above. Sensor portion 136 may include an internal well 139 for receiving a temperature sensor assembly 149. A temperature sensor 128 may be disposed at the distal end of temperature sensor assembly 149. The elongated stem of sensor portion 136 may include several different regions or portions. For example, sensor portion 136 may include a first portion 137, a first threaded region 138 extending around the exterior of the sensor portion 136, a second threaded region 135 extending around the exterior of the sensor portion, and an open end region 148. The first threaded region 138 may be configured to threadably engage a threaded spud in the water tank 12. In some instances, temperature sensor assembly 149 may extend distally beyond open end region 148.

Sensor portion 136 may include a shell 150 configured to threadably engage second threaded region 135. Shell 150 may include a threaded region 142 configured to engage second threaded region 135. A sealing member 146, such as an O-ring or gasket may be positioned between shell 150 and the open end region 148. The sealing member 146 may help prevent water from entering cavity 152 within shell 150 and engaging and possibly damaging the temperature sensor 128. An outer surface of the proximal end of shell 150 may form a thread lead-in region 140 disposed between a distal end region 144 of shell 150 and first threaded region 138. Thread lead-in region 140 may be configured to help guide the sensor portion 136 into the aperture 30 of the water tank 12 with proper alignment for the first threaded region 138 to engage the threaded spud in the water tank 12. In some embodiments, the thread lead-in region 140 may have zero draft for maximum effectiveness, but this is not required. When first threaded region 138 is engaged with the threaded water heater spud, distal end region 144 may be disposed within water tank 12. As shown, distal end region 144 may house a temperature sensor 128 such that when the bracket is engaged with the water tank 12, the temperature sensor 128 is in at least partial thermal communication with the water in the water tank 12. In some cases, the temperature sensor 128 may engage the inside surface of the shell 150.

In some instances, distal end region 144 of shell 150 may have a reduced cross-sectional area relative to the sensor portion 136. However, it is contemplated that in some cases, the cross-sectional area of distal end region 144 may be the same as, or substantially the same as the sensor portion 136. In some embodiments, distal end region 144 may include a cutting element (not explicitly shown) disposed at or near the tip. In some instances, the cutting element may include a blade-like feature. The cutting element may be capable of puncturing and/or piercing a plastic sheet or barrier commonly wrapped around the water tank 12 of many water heaters during installation of the bracket 32. It is contemplated that in some cases, the cutting element may be omitted from the design.

Shell 150 may be constructed from the same material as the remaining regions of sensor portion 136 or may be constructed from a different material. It is contemplated that sensor portion 136 may be formed of a relatively inexpensive material, such as nylon, while shell 150 may be formed of a material more resistant to water degradation. In some instances, shell 150 may be formed of brass. However, it is contemplated that shell 150 may be formed of any material desired, such as, but not limited to: stainless steel, other metals or metal alloys, ceramics, polymers, or polymer blends. In some instances, the distal end region 144 of shell 150 may be cylindrically shaped. However, this is not required. It is contemplated that the distal end region 144 may take any shape desired. In some instances, the shape of the distal end region 144 may generally conform to the shape of the temperature sensor 128.

Figure 8:
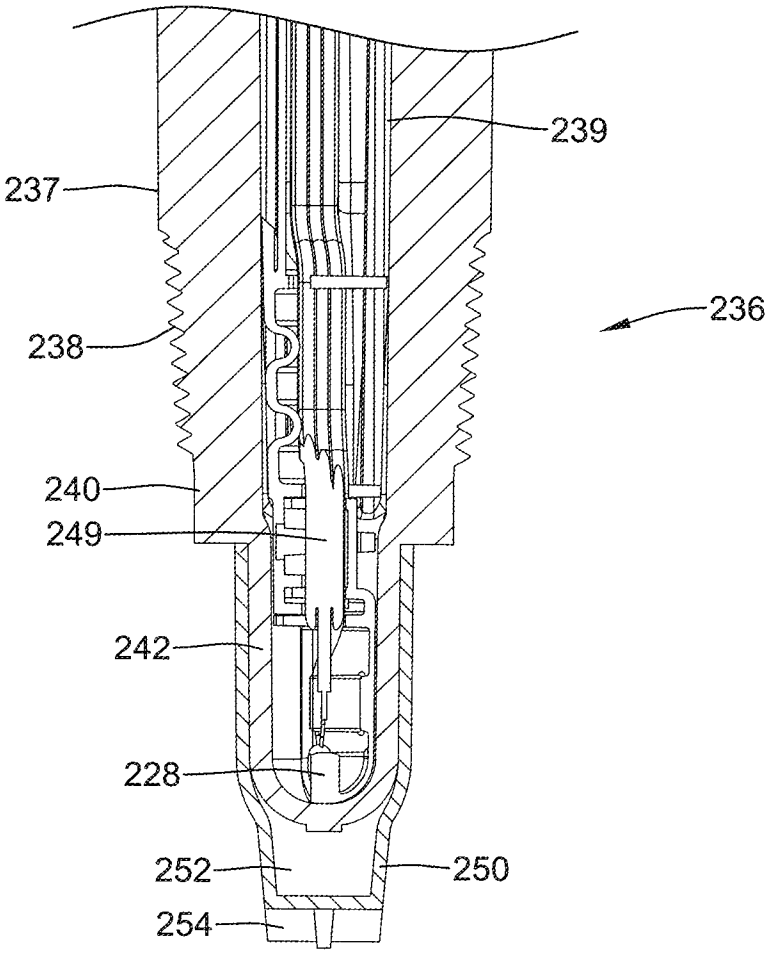
FIG. 8 is a cross-sectional side view of an end portion of another illustrative but non-limiting mounting bracket.

FIG. 8 illustrates another illustrative sensor portion 236 having a shell 250 that may be used in conjunction with a mounting bracket similar to bracket 32 discussed above. While not explicitly shown, it is contemplated that sensor portion 236 may extend from a gas valve retaining portion, having similar form and function to retaining portion 34 discussed above. Sensor portion 236 may include an internal well 239 for receiving a temperature sensor assembly 249. A temperature sensor 228 may be disposed at the distal end of the temperature sensor assembly 249. The elongated stem of sensor portion 236 may include several different regions or portions. For example, sensor portion 236 may include a first portion 237, a first threaded region 238 extending around the exterior of the sensor portion 236, a thread lead-in portion 240, and an enclosed distal end region 242. The first threaded region 238 may be configured to threadably engage a threaded spud in the water tank 12. Thread lead-in region 240 may be disposed between the distal end region 242 and the threaded region 238, and may be configured to help guide the sensor portion 236 into the aperture 30 of the water tank 12 (see FIG. 2) with proper alignment for the threaded region 38 to engage the threaded spud in the water tank 12. In some embodiments, the thread lead-in region 240 may have zero draft for maximum effectiveness, but this is not required. When threaded region 238 is engaged with the threaded water heater spud, distal end 242 of the sensor portion 236 may be disposed within water tank 12. Distal end 242 may house a temperature sensor 228 such that when the bracket 32 is engaged with the water tank 12, the temperature sensor 228 is in at least partial thermal communication with the water in the water tank 12. In some instances, distal end region 242 may have a reduced cross-sectional area relative to remaining regions 237, 238 and 240 of sensor portion 236. However, it is contemplated that in some cases, the cross-sectional area of distal end 242 may be the same as, or substantially the same as the remaining regions 237, 238 and 240 of sensor portion 236.

In some embodiments, distal end region 242 may include a shell or shell 250 configured to protect distal end region 242 from water related degradation. Shell 250 may be disposed over distal end region 242 and secured to the sensor portion 236. In some instances, shell 250 may be formed by shrink wrapping a polymeric material that is disposed over the distal end region 242. The shrink wrap material may be any material desired to provide the desired protection from water related degradation. In some cases, the shell 50 may include a dip coating that is dip coated on the outer surface of the distal end region 242 of the sensor portion 236. In some embodiments, shell 250 may be larger than distal end region 242.

In some cases, a cavity 252 may be present between shell 250 and distal end region 242, but this is not required. In some instances, and when a cavity 252 is provided, the cavity 252 may be filled with a thermally conductive silicone gel (not explicitly shown) to facilitate heat transfer. It is contemplated that in some embodiments, a thermally conductive adhesive may be disposed within cavity 252 to help secure shell 250 to sensor portion 236. In other embodiments, shell 250 may be sized and shaped to generally conform to the outer surface of distal end region 242. In some cases, the cavity 252 may be filled with water from the water tank when the bracket is installed on a water heater. In some cases, one or more holes may be added to the shell 250 to allow water to flow into and out of the cavity 252, but at a reduced the volumetric flow rate relative to when no shell 250 is provided. In some cases, at least part of the shell 250 may be made from a screen or grate that allows water to flow through but at a reduced volumetric flow rate. It is contemplated that shell 250 may be of any size or shape desired. For example, in some instances shell 250 may extend over thread lead-in portion 240 and/or beyond the distal end of distal end region 242, as desired.

In some embodiments, shell 250 may include a cutting element 254 disposed at or near the tip. In some instances, the cutting element may include a blade-like feature. The cutting element may be capable of puncturing and/or piercing a plastic sheet or barrier commonly wrapped around the water tank 12 of many water heaters during installation of the bracket 32. It is contemplated that in some cases, the cutting element may be omitted from the design.

Figure 9:
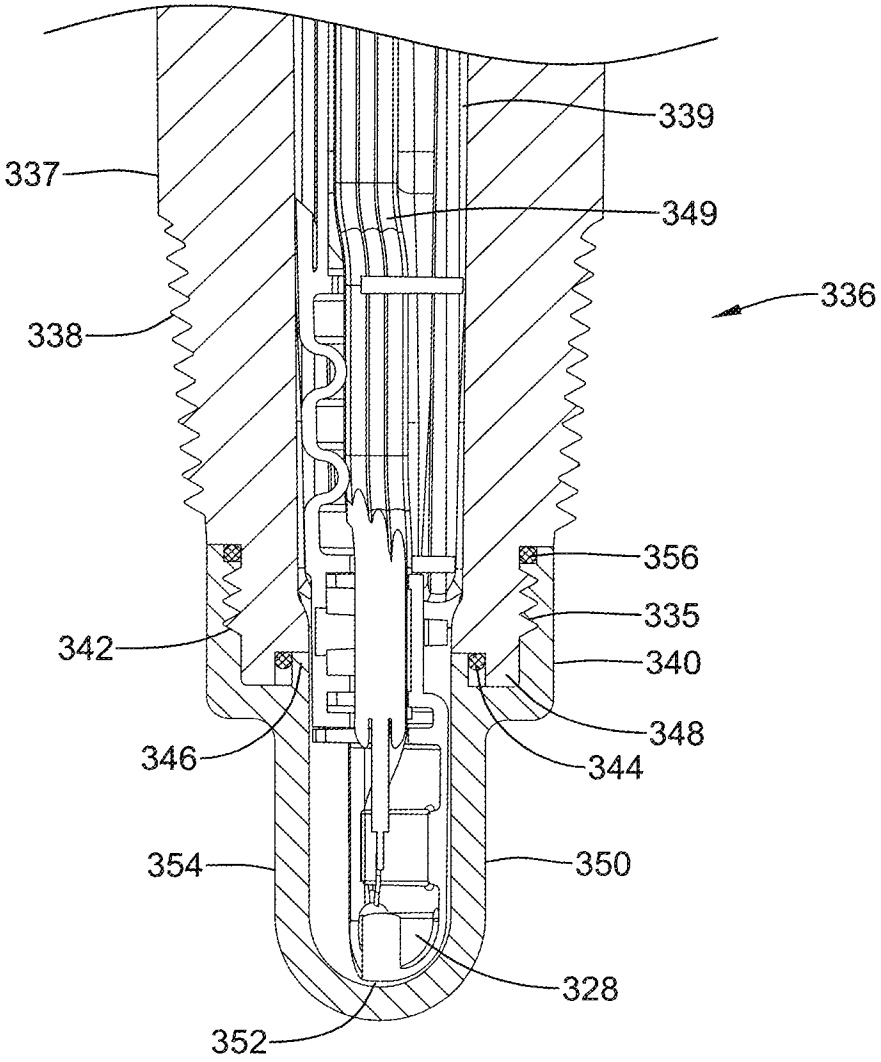
FIG. 9 is a cross-sectional view of an end portion of yet another illustrative but non-limiting mounting bracket.

FIG. 9 illustrates another illustrative sensor portion 336 having a shell 350 that may be used in conjunction with a mounting bracket similar to bracket 32 discussed above. While not explicitly shown, it is contemplated that sensor portion 336 may extend from a gas valve retaining portion, having similar form and function to retaining portion 34 discussed above. Sensor portion 336 may include an internal well 339 for receiving a temperature sensor assembly 349. A temperature sensor 328 may be disposed at the distal end of assembly 349. The elongated stem of sensor portion 336 may include of several different regions or portions. For example, sensor portion 336 may include a first portion 337, a first threaded region 338 extending around the exterior of the sensor portion 336, a second threaded region 335 extending around the exterior of the sensor portion, and an open end region 348. The first threaded region 338 may be configured to threadably engage a threaded spud in the water tank 12. In some instances, temperature sensor assembly 349 may extend distally beyond distal end region 348. Sensor portion 336 may also include a shell 350 configured to threadably engage second threaded region 335. Shell 350 may include a threaded region 342 configured to engage second threaded region 335. A first sealing member 356, such as an O-ring or gasket may be positioned between shell 350 and the first threaded region 338. A second sealing member 344, such as an O-ring or gasket may be positioned between a protrusion 346 in the shell 350 and the open end region 348 of the sensor portion 336. The sealing members 344, 356 may help prevent water from entering a cavity 352 within shell 350 and engaging and possibly damaging the temperature sensor 328.

An outer surface of the proximal end of shell 350 may form a thread lead-in region 340 disposed between a distal end region 354 of shell 350 and first threaded region 338. Thread lead-in region 340 may be configured to help guide the sensor portion 336 into the aperture 30 of the water tank 12 (see FIG. 2) with proper alignment for the first threaded region 338 to engage the threaded spud in the water tank 12. In some embodiments, the thread lead-in region 340 may have zero draft for maximum effectiveness, but this is not required. When first threaded region 338 is engaged with the threaded water heater spud, distal end 354 may be disposed within water tank 12. Distal end 354 may house a temperature sensor 328 such that when the bracket is engaged with the water tank 12, the temperature sensor is in at least partial thermal communication with the water in the water tank 12.

In some instances, distal end region 354 of shell 350 may have a reduced cross-sectional area relative to the sensor portion 336. However, it is contemplated that in some cases, the cross-sectional area of distal end 354 may be the same as, or substantially the same as the sensor portion 336. In some embodiments, distal end 354 may include a cutting element (not explicitly shown) disposed at or near the tip. In some instances, the cutting element may include a blade-like feature. The cutting element may be capable of puncturing and/or piercing a plastic sheet or barrier commonly wrapped around the water tank 12 of many water heaters during installation of the bracket 32. It is contemplated that in some cases, the cutting element may be omitted from the design.

Shell 350 may be constructed from the same material as the remaining regions of sensor portion 336 or may be constructed from a different material. It is contemplated that sensor portion 336 may be formed of a relatively inexpensive material, such as nylon, while shell 350 may be formed of a material more resistant to water degradation. In some instances, shell 350 may be formed of a heat resistant polymer. However, it is contemplated that shell 350 may be formed of any material desired, such as, but not limited to: stainless steel, brass, other metals or metal alloys, ceramics, polymers, or polymer blends. In some instances, the distal end region 354 of shell 350 may generally conform to the shape of the temperature sensor 328, as shown in FIG. 9. It is contemplated that the distal end region 354 may take any shape desired.

The disclosure should not be considered limited to the particular examples described above, but rather should be understood to cover all aspects of the disclosure as set out in the attached claims. For example, it is contemplated that features shown and described with respect to one Figure may be applied to illustrative brackets shown and described with respect to other Figures. More generally, various modifications, equivalent processes, as well as numerous structures to which the disclosure can be applicable will be readily apparent to those of skill in the art upon review of the instant specification.

What is claimed is:

1. A bracket for a water heater with a water tank, the bracket comprising:

a polymeric body having a sensor portion, the sensor portion configured to receive a temperature sensor at least partially within the sensor portion;

a shell disposed over and surrounding at least a portion of the sensor portion of the polymeric body; and wherein the polymeric body includes a first threaded portion that is configured to threadably engage a threaded spud of the water heater such that the sensor portion extends into the water tank of the water heater and, when the first threaded portion is threadably engaged with the threaded spud of the water heater, the polymeric body fluidly isolates the temperature sensor from water in the water tank.

2. The bracket of claim 1, wherein the shell and the polymeric body are formed from different materials.

3. The bracket of claim 1, wherein the shell includes stainless steel.

4. The bracket of claim 1, wherein the shell includes brass.

5. The bracket of claim 1, wherein the shell includes a polymeric material.

6. The bracket of claim 1, wherein a cavity is formed between the shell and the sensor portion.

7. The bracket of claim 6, wherein the cavity is at least partially filled with a thermally conductive silicone gel.

8. The bracket of claim 1, wherein the shell is mechanically deformed to secure the shell to the sensor portion.

9. The bracket of claim 8, wherein the shell is crimped adjacent a groove in the sensor portion.

10. The bracket of claim 1, further comprising a gap between an outer surface of the sensor portion of the polymeric body and an inner surface of the shell.

11. The bracket of claim 10, wherein when the first threaded portion is threadably engaged with the threaded spud of the water heater, water from the water tank enters the gap between the sensor portion and the shell.

12. The bracket of claim 1, wherein the shell includes a threaded region configured to engage a second threaded region on the sensor portion.

13. The bracket of claim 1, wherein the shell is shrink wrapped over at least part of the sensor portion.

14. The bracket of claim 1, wherein the polymeric body includes nylon.

15. A bracket for a water heater with a water tank, the bracket comprising:

a body having a component retaining region and an elongated stem extending from the component retaining region, the elongated stem having an internal well for receiving a temperature sensor;

the body including a threaded portion that extends around the elongated stem for threadably engaging a threaded spud of the water heater such that when the threaded portion threadably engages the threaded spud of the water heater, the elongated stem extends into the water tank of the water heater and fluidly isolates the temperature sensor from water in the water tank;

the body being molded as a single piece from a polymeric material; and a shell disposed over and surrounding a distal end region of the elongated stem.

16. The bracket of claim 15, wherein the polymeric material includes nylon and the shell includes stainless steel.

17. The bracket of claim 15, wherein the shell is mechanically deformed to secure the shell to the elongated stem.

18. The bracket of claim 15, wherein a cavity is formed between the shell and the elongated stem.

19. The bracket of claim 18, wherein the cavity is at least partially filled with a thermally conductive silicone gel.

20. A bracket for a water heater having a water tank, the bracket comprising:

a polymeric body having a component retaining region and an elongated stem extending from the component retaining region, the elongated stem having an internal well for receiving a temperature sensor;

the elongated stem including a threaded portion that extends around the elongated stem for threadably engaging a threaded spud of the water heater such that when the threaded portion threadably engages the threaded spud of the water heater, the elongated stem extends into the water tank of the water heater and fluidly isolates the temperature sensor from water in the water tank, the elongated stem further including a groove that extend at least partially around the elongated stem and is positioned distal of the threaded portion;

the polymeric body being molded as a single piece from a nylon material; and a metal shell disposed over and surrounding a distal end region of the elongated stem;

wherein the metal shell extends into the groove in the elongated stem to secure the metal shell to the elongated stem.

* * * * *